US006250015B1

(12) United States Patent
Gillispie

(10) Patent No.: US 6,250,015 B1
(45) Date of Patent: Jun. 26, 2001

(54) SELF-LATCHING MECHANISM FOR A SAFETY CABINET

(75) Inventor: John G. Gillispie, Glen Dale, WV (US)

(73) Assignee: Eagle Manufacturing Company, Wellsburg, WV (US)

( * ) Notice: Subject to any disclaimer, the term of this patent is extended or adjusted under 35 U.S.C. 154(b) by 0 days.

(21) Appl. No.: 09/707,322

(22) Filed: Nov. 7, 2000

Related U.S. Application Data

(63) Continuation-in-part of application No. 09/455,818, filed on Dec. 4, 1999, now abandoned.

(51) Int. Cl.[7] ..... E05C 7/04
(52) U.S. Cl. ..... 49/367; 312/324
(58) Field of Search ..... 49/366, 367, 394, 49/395; 292/7, 40, 332; 312/324, 326, 329, 295

(56) References Cited

U.S. PATENT DOCUMENTS

| | | | |
|---|---|---|---|
| 3,822,506 | 7/1974 | Fishbach | 49/366 |
| 3,919,808 | 11/1975 | Simmons | 49/366 |
| 4,146,994 | 4/1979 | Williams | 49/367 |
| 4,262,448 | 4/1981 | Flider | 49/367 |
| 4,265,051 | 5/1981 | Williams | 49/7 |
| 4,619,076 | 10/1986 | Livingston | 49/367 |
| 5,061,022 | 10/1991 | Meriwether | 312/324 |
| 5,944,399 | 8/1999 | Gillispie | 312/324 |
| 5,992,098 | 11/1999 | Flider et al. | 49/1 |

*Primary Examiner*—Jerry Redman
(74) *Attorney, Agent, or Firm*—Armstrong, Westerman, Hattori, McLeland & Naughton, LLP

(57) ABSTRACT

A mechanism for self-latching access doors of a safety cabinet following sequential self-closing of the doors. Latching takes place between the doors and at a top and bottom frame of the cabinet. A latching arm and two actuating arms extend from a bellcrank which is biased toward a latched position. An interference bar prevents rotation of the bellcrank to the latched position when the doors are open. Upon sequential self-closing of the doors an actuating means slides the interference bar to a position of non-interference with the bellcrank which enables the self-latching action to take place.

12 Claims, 13 Drawing Sheets

SELF-LATCHING MECHANISM FOR A SAFETY CABINET

This application is a continuation-in-part of application Ser. No. 09/455,818 filed Dec. 4, 1999, now abandoned, the contents of which are incorporated herein.

BACKGROUND OF THE INVENTION

1. Field of the Invention

The present invention relates to safety cabinets for storage of combustible, volatile or other hazardous materials and more specifically to safety cabinets having doors which are self-closing in a sequential order and are self-latching at three points following closing.

2. Description of Prior Art

Use of safety cabinets for storage of paints, solvents, lubricants and various other combustibles, volatile and hazardous materials is required by most safety regulations and fire codes. To isolate the interior of the cabinet and protect its contents from the heat and flames of a fire or to contain a fire within the cabinet, door(s) of a safety cabinet, in most cases, have a fusible link to trigger self-closing of the door(s) when the fusible link reaches a selected temperature. Cabinets having two doors utilize sequencing mechanisms to assure that a particular door closes prior to the other door so as to obtain a seal at a lip which extends from the edge of one of the doors and overlaps the other door.

To provide a more secure enclosure and maximize safety, a self-latching mechanism is utilized to latch the doors following self-closing. Most safety regulations require latching at three points on the cabinet. Examples of such self-latching mechanisms are described in U.S. Pat. Nos. 4,146,944 and 4,265,051, both with Williams as the inventor, which describe a "three-point latching mechanism" which includes a center latch and a pair of vertically oriented rods, a top rod extending from the latch mechanism to the top edge of the door and a bottom rod extending from the latch mechanism to the bottom edge of the door. When in latched position the center latch engages a second door and ends of the rods extend through apertures in the door frame. The mechanism is biased by a spring toward the latched position but is restrained from reaching that position by a notch in the bottom rod which fits over a bracket positioned on the door near the lower end of the bottom rod. The notch is biased to catch on the bracket by a leaf spring acting on the rod. When the door is closed the bottom rod contacts an upturned flange on the door housing to release the notch from the bracket and allow the latch and rods to engage.

U.S. Pat. No. 5,061,022 describes a latching mechanism which includes a latch spring biased to move to a latched position and a plurality of levers. The latch is prevented from latching by a locking pin engaged in a positioning lever slot. The pin is disengaged from the slot when an actuating lever contacts a jamb stop when the door is closed. The jamb stop is located in the side door jamb to which the door is hinged.

U.S. Pat. No. 4,262,448 describes a latching mechanism having a center latch and a top and a bottom latch rod which engages the top and bottom frame of the cabinet. The mechanism is spring biased toward a latched position. The top rod incorporates a shoulder which engages a latch bracket and a leaf spring biases the rod to maintain the engagement. Upon closing the door a latch stop in the top frame of the cabinet contacts the rod to dislodge the shoulder from the latch bracket which allows the biased latching mechanism to latch.

U.S. Pat. No. 4,619,076 describes a latching mechanism having a latch rod with an inclined upper end. The rod is spring biased toward an upward latched position. Upon closing of the door the inclined upper end of the rod contacts a top frame of the cabinet which forces the rod downward to pass by a corner of the frame and then engage an aperture in the frame when the door is completely closed.

SUMMARY OF THE INVENTION

The present invention provides, in a preferred embodiment, three point self-latching for a safety cabinet having two sequentially closing (a first-closing and a second-closing) side-by-side doors. The second-closing door has a rotatable bellcrank within its cavity which is attached to an exterior rotatable handle. The bellcrank has a protruding latching arm for engaging the first-closing door and two additional latching arms, each of which connects to a rod which extends through a frame of the cabinet to achieve latching. The bellcrank is biased to rotate toward a position at which such latching is achieved. Rotation to the latched position is prevented by an interference bar which is slidable from a position whereat it does not interfere with the latching arm to a position whereat it interferes with the latching arm. The bar is biased to the position at which it interferes with the latching arm. Upon sequential closing of the doors, a mechanism overrides the bias of the interference bar to slide the bar to a position of non-interference which then allows the bellcrank to rotate to the latched position thus achieving the three-point latching. Those and other specific features and contributions of the invention are described in more detail with reference being made to the accompanying drawings.

DETAILED DESCRIPTION OF THE INVENTION

Figure 1:
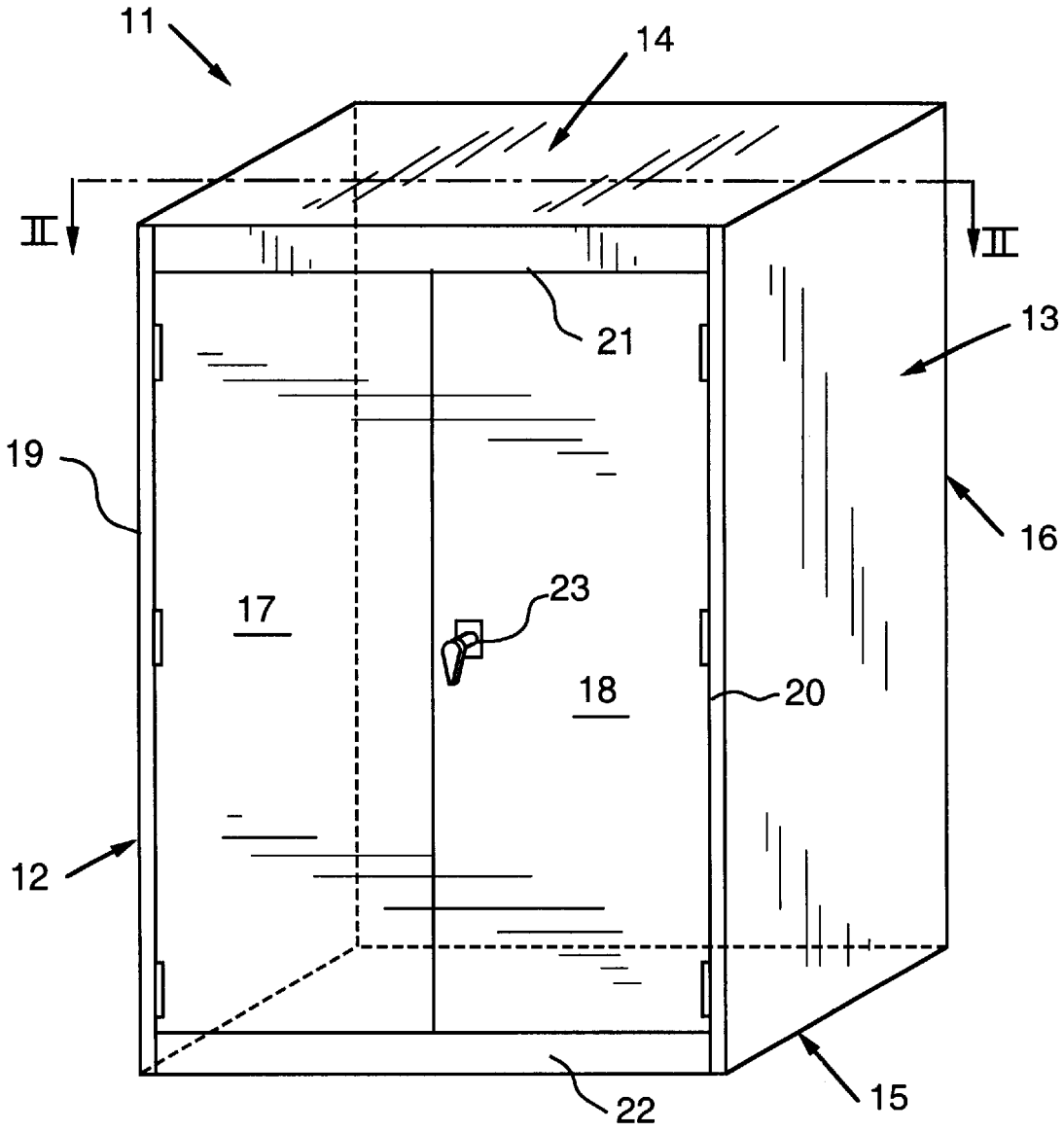
FIG. 1 Prior Art
FIG. 1 is an isometric front view of a prior art safety cabinet.

FIG. 1 depicts, in general, a safety cabinet used for storing flammable, volatile or otherwise hazardous materials. The stored materials are isolated, in the event of a fire, by the enclosure of the cabinet having its doors in a closed and latched condition. Safety cabinet 11 has opposed sides 12 and 13, top 14 bottom 15, and back 16. Access to the cabinet's contents is by opening doors 17 and 18 which are hinged at side jambs 19 and 20, which along with top frame 21 and bottom frame 22, make up the frame for the doors. Exterior handle 23 is used to manually unlatch the doors in order to gain access to the cabinet.

Panels making up the sides, top, bottom and back of the cabinet are in most cases double-walled, either hollow or filled with an insulating material, to retard the transfer of heat through the panels. The doors can be of similar double-walled construction and such cabinet and construction is known in the art.

Figure 2:
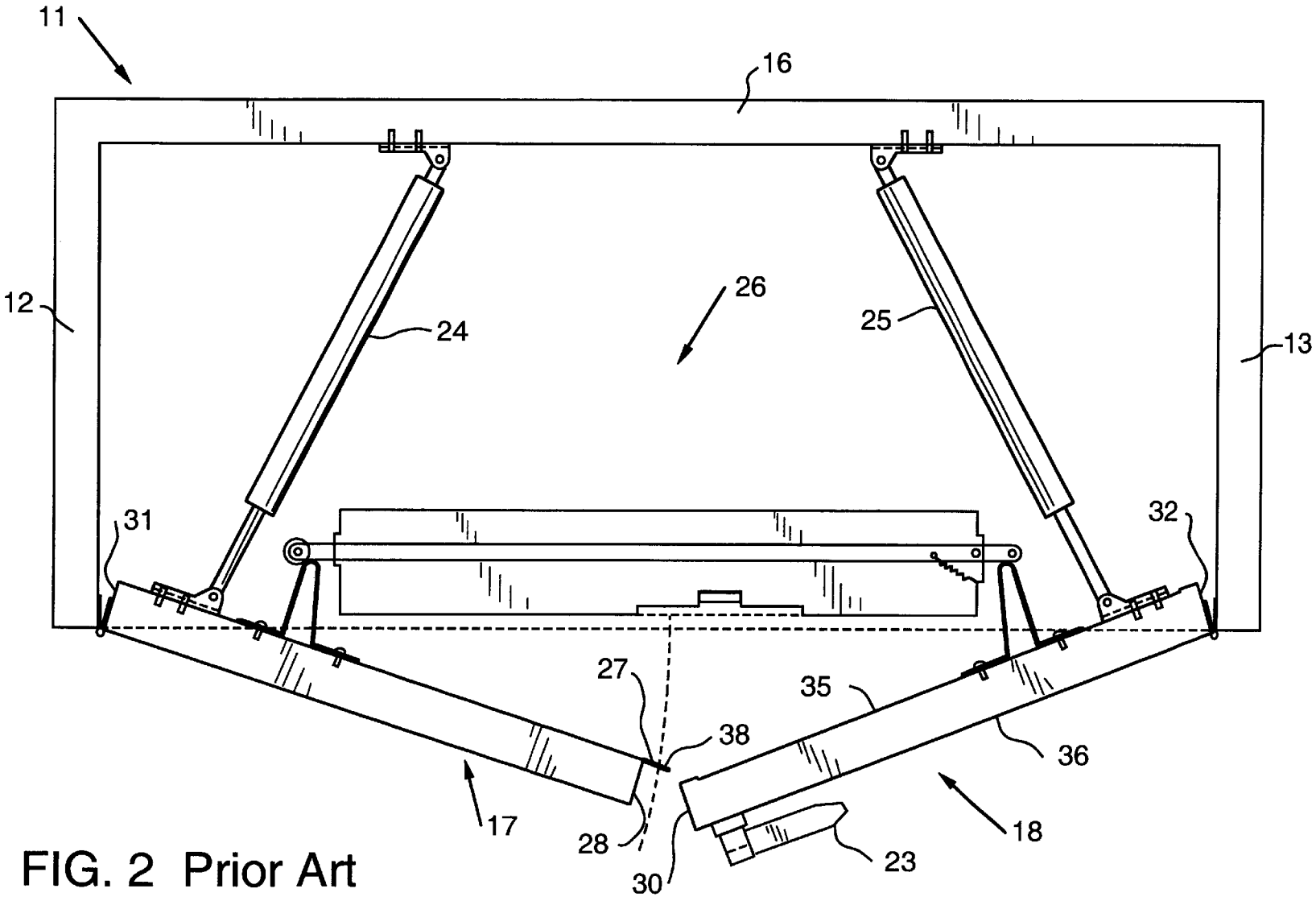
FIG. 2 Prior Art
FIG. 2 is a sectional view of the cabinet of FIG. 1, taken in a plane indicated at II—II, having a prior art sequentially self-closing mechanism for the doors.

FIG. 2 is a sectional view of the cabinet of FIG. 1 taken in a plane indicated by interrupted lines II—II. FIG. 2 depicts safety cabinet 11 having double-walled back 16 and side walls 12 and 13. Doors 17 and 18, have self-closing actuators 24 and 25 respectively, with the order of closing being controlled by a sequential closing mechanism generally indicated at 26. Such mechanism is the subject of U.S. Pat. No. 5,944,399 which is incorporated herein by reference and which has the same assignee as the present application.

The sequential closing mechanism in the preferred embodiment closes door 17 first, followed by door 18. The doors are termed first-closing and second-closing doors respectively. Safety cabinets, in most cases, contain a fusible link (not shown) which triggers closing of the doors when the link reaches a selected temperature. A lip 27 extends laterally from first-closing door 17 to provide a seal along latching edges 28 and 30 of doors 17 and 18 respectively. The latching edges are opposed to hinging edges 31 and 32 for doors 17 and 18 respectively and the latching edges oppose each other when closed. In addition to providing a seal, lip 27 also effectively secures door 17 in the closed condition by the action of door 18 contacting lip 27 along its entire length. A self-latching mechanism, triggered by closing of the doors, is the subject of the present invention and two embodiments of the mechanism are depicted in various stages of operation in the following views.

In FIGS. 3–7 door 18 is shown in elevational view with cut away section 33 to expose self-latching mechanism 34. The majority of the self-latching mechanism is located between interior facing panel 35 and exterior facing panel 36 of door 18. The arrangement of the mechanism and facing panels is best viewed in FIGS. 8A and 8B (partial sectional top views of the doors). The location, between the facing panels, is referred to as a door cavity and is indicated at 37.

As illustrated in FIGS. 3–7 doors 17 and 18 are framed by side jambs 19 and 20, top frame 21, and bottom frame 22. First-closing door 17 has hinging edge 31 and latching edge 28; second-closing door 18 has hinging edge 32 and latching edge 30. Hinges are indicated at 29 and interrupted line 38 indicates the edge of lip 27 extending laterally from first-closing door 17.

Figure 3:
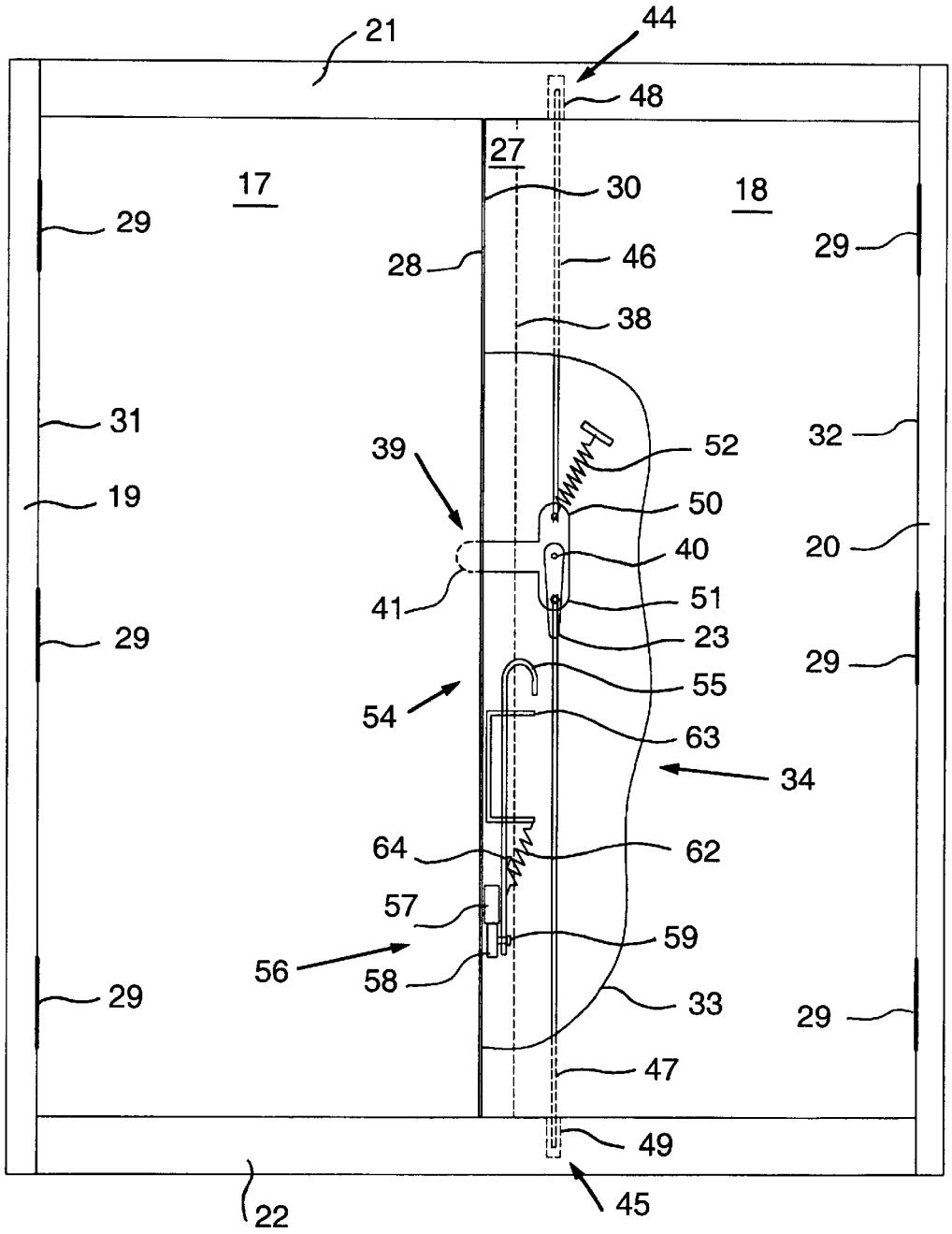
FIG. 3 is an elevational view of a safety cabinet with a portion broken away to show a first embodiment of the actuating means of the self-latching mechanism of the invention, in the latched position.

FIG. 3 depicts self-closing mechanism 34 and the doors at a stage at which both of the doors are closed and the mechanism is in a latched position. That stage can result from manually closing and latching the doors or from self-closing and self-latching of the doors, for example, by being triggered by melting of a fusible link as described above. At the stage depicted in FIG. 3, bellcrank 39, which is attached to shaft 40 and exterior handle 23, is in a latched position. That is, latching arm 41 is engaging first-closing door 17 at its latching edge 28. Such engagement is made by latching arm 41 passing through a slot 42 (best viewed in FIGS. 8A, and 8B) in latching edge 30 of door 18 and a slot 43 in latching edge 28 of door 17. Latching also takes place at top frame 21, at 44, and at bottom frame 22, at 45, with engagement of latching rods 46 and 47 respectively. Rods 46 and 47 preferably extend into apertures 48 and 49 respectively. The rods are pivotally attached to latching arms 50 and 51 of bellcrank 39. Latching arms 50 and 51 of bellcrank 39 rotate about shaft 40 which extends from the bellcrank 39 through exterior facing panel 36 (see FIGS. 8A and 8B) and is attached to exterior handle 23. As indicated in those figures, shaft 40 can extend through interior facing panel 35 to provide a second rotational bearing surface for shaft 40. Referring back to FIG. 3, bellcrank 39 is biased toward the latched position by coil spring 52. Bellcrank 39, shaft 40, and exterior handle 23 form an integral unit which rotates together by either rotation of exterior handle 23, for example, by a worker opening or closing the doors, or by rotation of the bellcrank by biasing spring 52 in the event of a fire.

Figure 4:
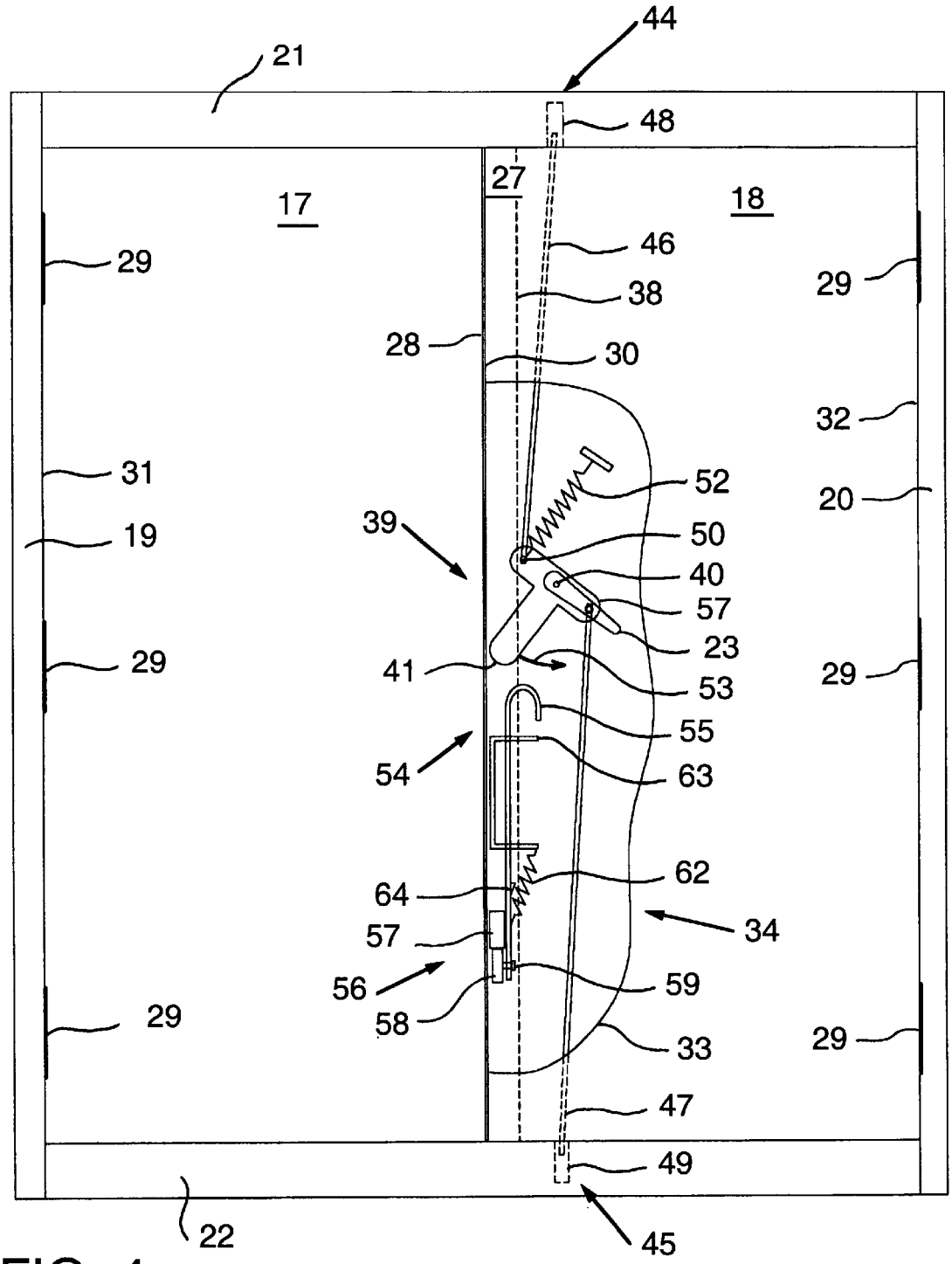
FIG. 4 is an elevational view of the safety cabinet with a portion broken away to show the first embodiment of the actuating means of the self-latching mechanism of the invention, during unlatching by rotation of an exterior handle.
Figure 5:
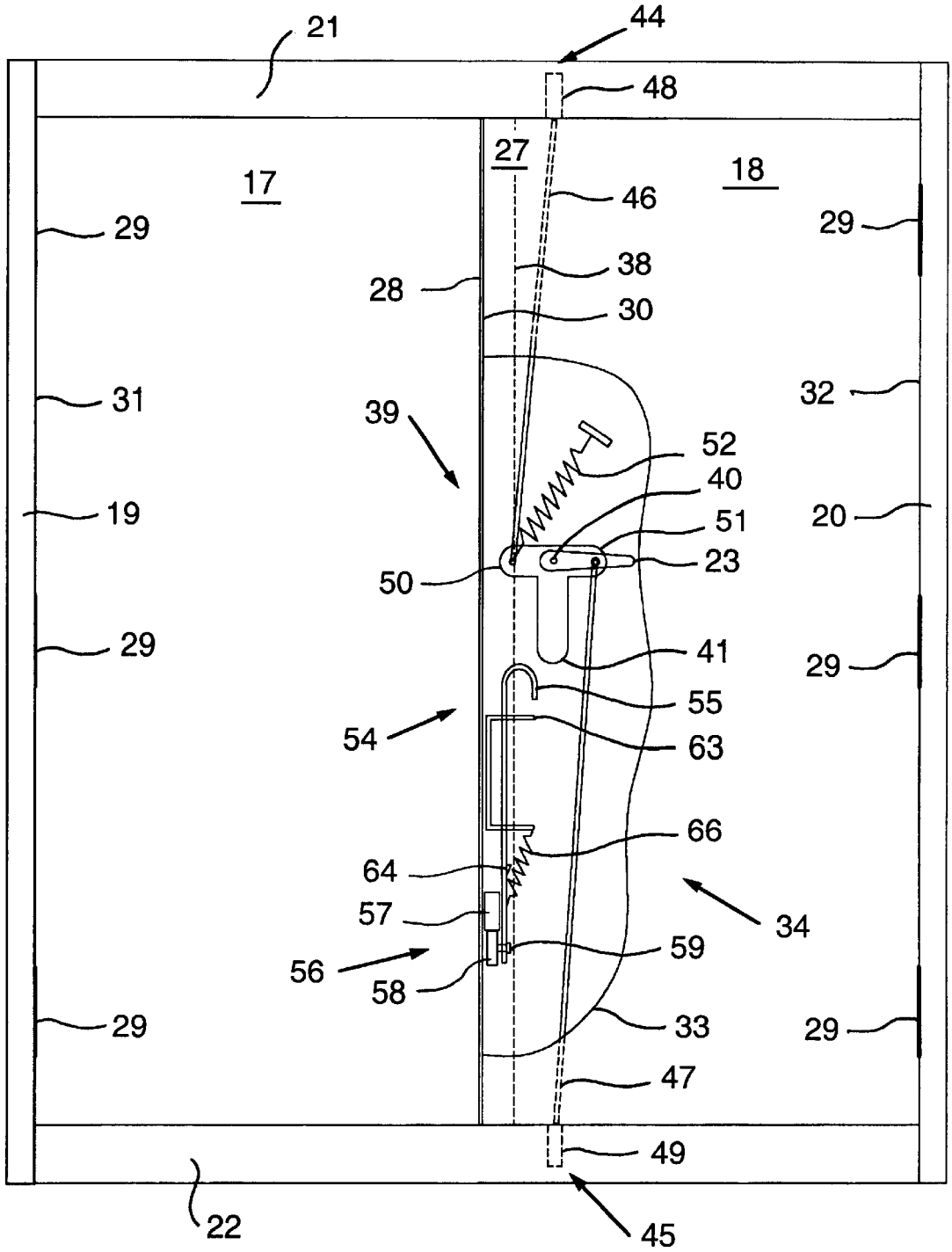
FIG. 5 is an elevational view of the safety cabinet with a portion broken away to show the first embodiment of the actuating means of the self-latching mechanism of the invention, completely unlatched and with the door in a closed position.

The position of bellcrank 39 in FIG. 3 (latched position) is contrasted with its position in FIG. 5, referred to as an unlatched position, in which the bellcrank (and the integral shaft and handle) are rotated approximately 90° counter-clockwise so as to completely eliminate engagement of latching arm 41 of bellcrank 39 with door 17 and remove engagement of latching rods 46 and 47 with top frame 21 and bottom frame 22. The counter-clockwise motion as bellcrank 39 is rotated from the latched to the unlatched position is indicated in FIG. 4 by arrow 53. The self latching mechanism as depicted in FIG. 5 is at a stage in which door 18 is not latched but is in the closed position.

In the stages depicted in FIGS. 3–5 an interference bar 54 (which in the preferred embodiment is "J" shaped, as shown) is at a non-interference position in relation to latching arm 41. That is, latching arm 41 of bellcrank 39 can rotate as described above without making contact with rounded end 55 of interference bar 54. That non-interference position is contrasted with the position of interference bar 54 in FIG. 6 which is at a position whereat interference does occur with latching arm 41 when rotation of bellcrank 39 is attempted.

Figure 6:
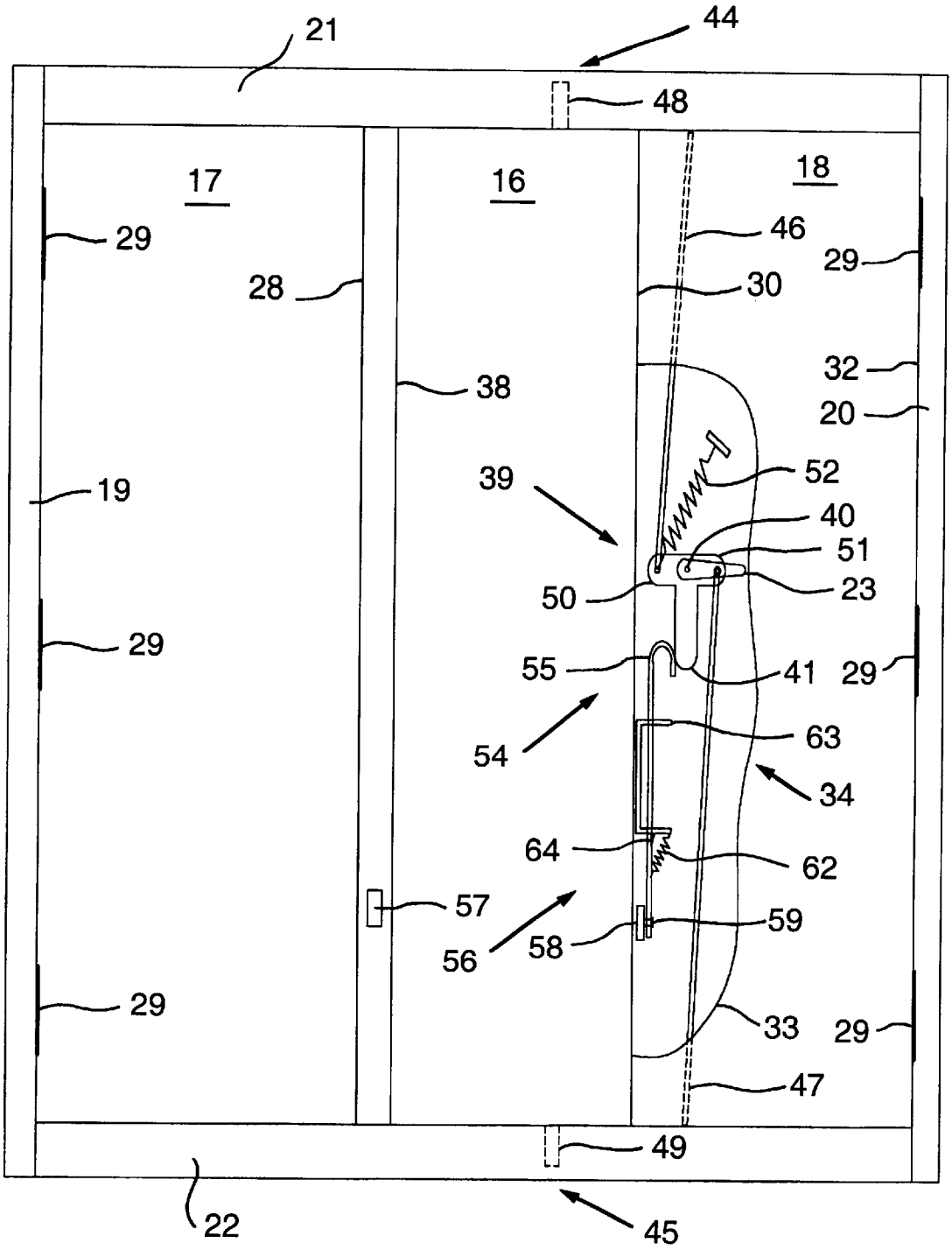
FIG. 6 is an elevational view of the safety cabinet with a portion broken away to show the first embodiment of the actuating means of the self-latching mechanism of the invention, in an unlatched position and the second-closing door opened.

FIG. 6 is an elevational view depicting a stage in which door 17 and, door 18 are partially open, and interference bar 54 is in the interference position. Doors 17 and 18 as well as components of self-closing mechanism 34 appear foreshortened, in FIG. 6, between edges 30 and 32, and edges 28 and 31 because of the doors being partially open. Safety cabinet back, 16, is visible between door edge 30 and edge 38 of lip 27. The position of interference bar 54 is controlled by actuating means indicated generally at 56. Two embodiments of the actuating means are described below.

The position of interference bar 54 is controlled, in part, in a first embodiment of the actuating means, by cam 57 (FIGS. 3–10). In the preferred embodiment the positioning action for interference bar 54 takes place through roller 58 on roller shaft 59. As best viewed in FIGS. 9A and 9B, cam 57 is attached to laterally extending lip 27 of first-closing door 17, and extends forwardly to contact roller 58 when second-closing door 18 approaches lip 27 during closing. FIG. 9A depicts the actuating components prior to closing and FIG. 9B depicts the actuating components when the doors are in a closed configuration. In FIG. 9A arrow 60 indicates how cam 57 is approached by roller 58 during closing of door 18 and arrow 61 indicates the direction of movement of roller 58 (as well as interference bar 54) when inclined plane 62 of cam 57 contacts the roller during closing. FIG. 9B indicates the relative positions of cam 57 roller 58, and interference bar 54 when both doors are completely closed. Cam 57 and roller 58 act against the force of spring 62 which biases interference bar 54 in the upward or interference position (indicated in FIG. 6). Spring 62 is attached to bracket 63 which slidably attaches interference bar 54 to second-closing door 18. Tab 64 on interference bar 54 limits movement of interference bar 54 in an upward direction by contacting bracket 63. Interaction of cam 57 and roller 58 is also depicted in partial section top views FIG. 8A (door open) and FIG. 8B (door closed). A slot 65 is provided in second-closing door 18 for entry of cam 57 which is attached to laterally extending lip 27 of first-closing door 17.

FIG. 6 depicts the self-latching mechanism in the "cocked" condition. That is the doors are opened but in ready for self-latching if triggered by melting of the fusible link and sequentially self-closed by self-closing mechanism 26 (FIG. 2). In the cocked condition, (FIG. 6), while spring 52 biases bellcrank 39 toward the latching position, interference bar 54 prevents rotation of bellcrank 39. Spring 62 biases interference bar 54 in the interference position and the interference position is maintained until cam 57 attached to lip 27 of door 17 makes contact with roller 58 when the doors are sequentially closed, as described above.

Figure 7:
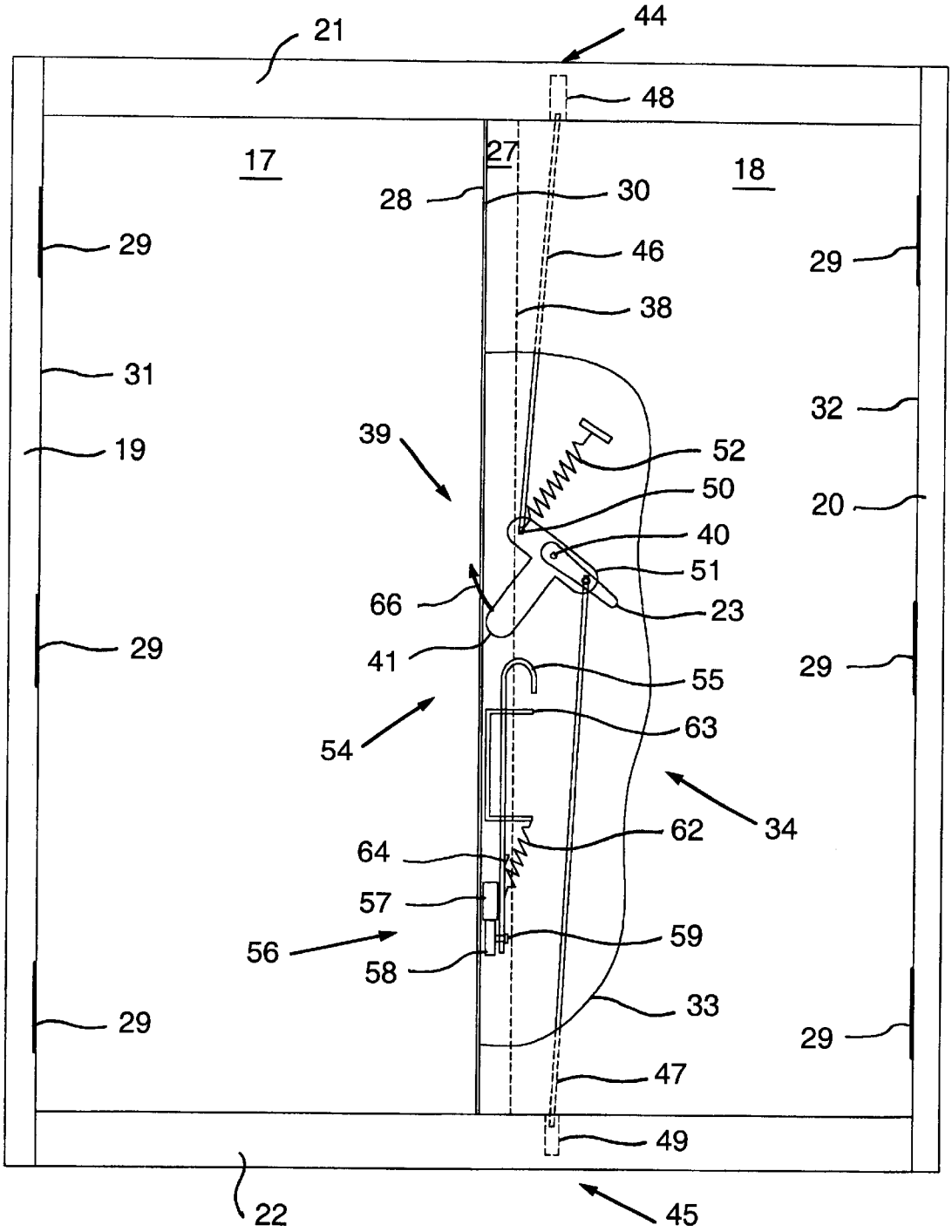
FIG. 7 is an elevational view of the safety cabinet with a portion broken away to show the first embodiment of the actuating means of the self-latching mechanism of the invention, during latching triggered by closing of the second-closing door.
Figure 8A:
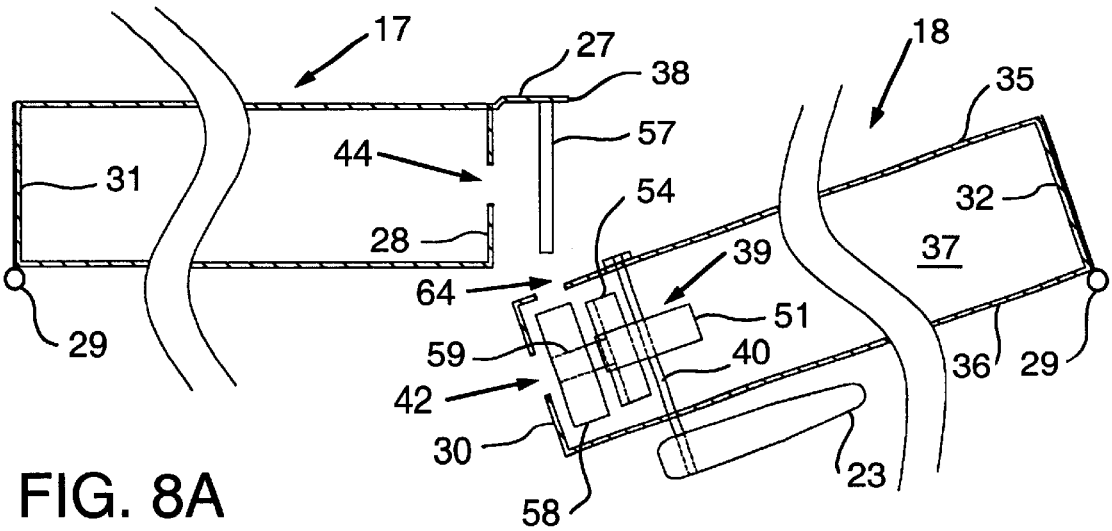
FIGS. 8A and 8B are partial sectional top views of the first-closing and the second-closing doors of the safety cabinet having the first embodiment of the actuating means of the self-latching mechanism of the invention, with the second-closing door being open in FIG. 8A and closed in FIG. 8B.
Figure 8B:
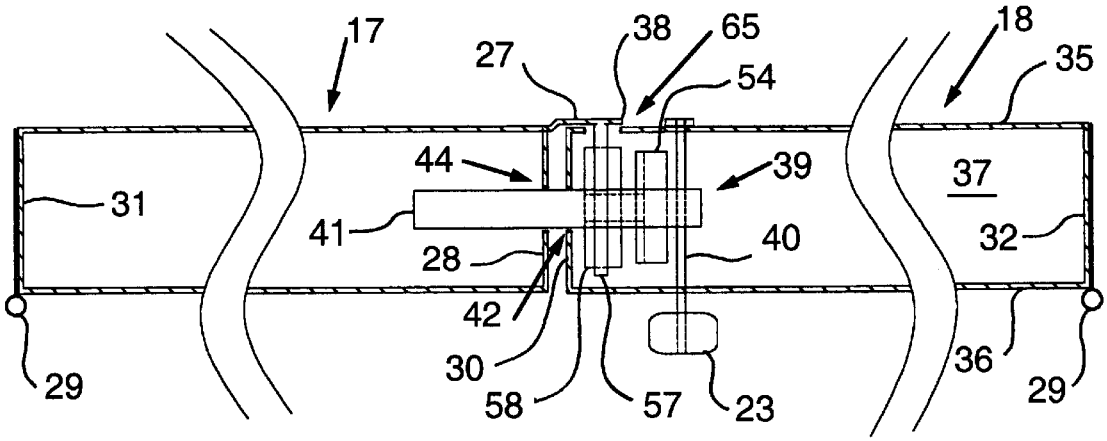
Figure 9A:
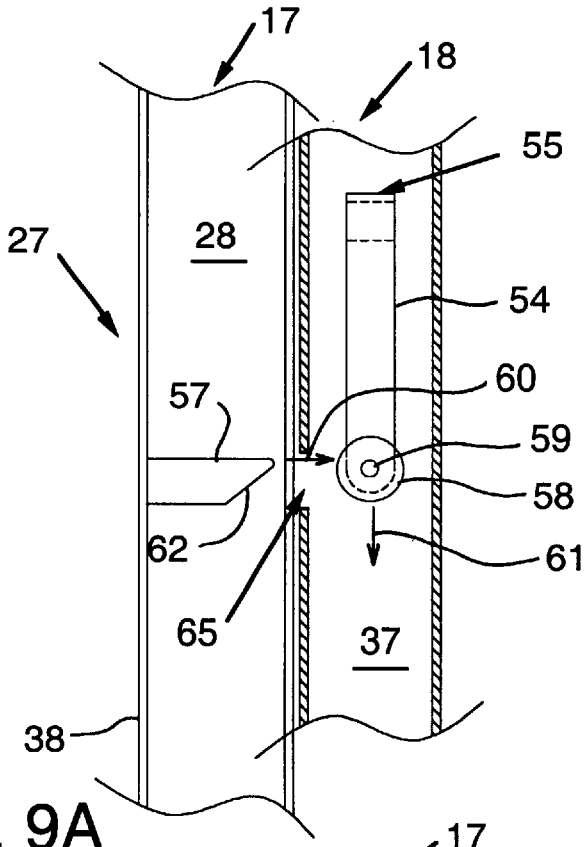
FIGS. 9A and 9B are partial sectional edge views of the first-closing and second-closing doors showing detail and operation of a cam component of the first embodiment of the actuating means of the self-closing mechanism of the invention, with the second-closing door being open in FIG. 9A and closed in FIG. 9B.
Figure 9B:
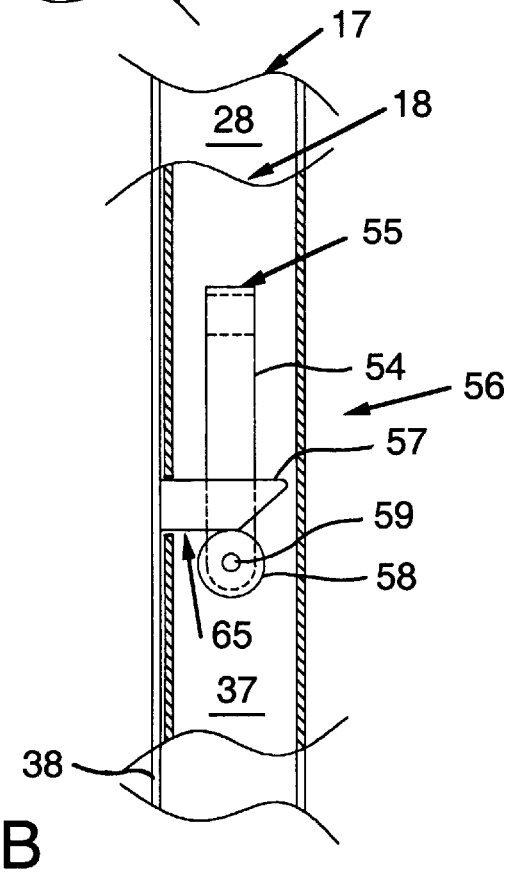

FIG. 7 depicts the self-latching operation in progress. First-closing door 17 has been closed through control of door closing mechanism 26; second-closing door 18 has begun closing, causing cam 57 to interact with roller 58 and move roller 58 downward (see FIGS. 9A and 9B) along with interference bar 54 movement of interference bar 54 downward enables bellcrank 39 to rotate clockwise, by force of biasing spring 52, as indicated by arrow 66, and latch into latching edge 28 of first-closing door 17 as well as latching by rods 46 and 47 entering apertures 48 and 49 of frames 21 and 22 respectively. At the completion of the self-latching operation, the components of the mechanism are positioned as depicted in FIG. 3. That positioning provides a secure enclosure which isolates the contents of the safety cabinet.

Of importance when manually opening the doors for access to contents of the safety cabinet are the lengths of latching rods 46 and 47 which engage the top and bottom frames 21, 22 by entering apertures 48 and 49 respectively. For proper operation of the self-latching mechanism, rods 46 and 47 should not retract from engagement with frames 21, 22 until bellcrank 39 has been rotated the complete 90° in the counter-clockwise direction. That requirement eliminates opening of second-closing door 18 prior to bellcrank 39 being in the position indicated in FIG. 5. Premature opening of door 18, moves cam 57 from contact with interference bar 54 thus allowing the bar to attain the interference position. If latching arm 41 has not passed interference bar 54, in movement as indicated by arrow 53 of FIG. 4, prior to release of interference bar 54 and its movement in an upward direction, proper operation of the mechanism will not occur.

Figure 10:
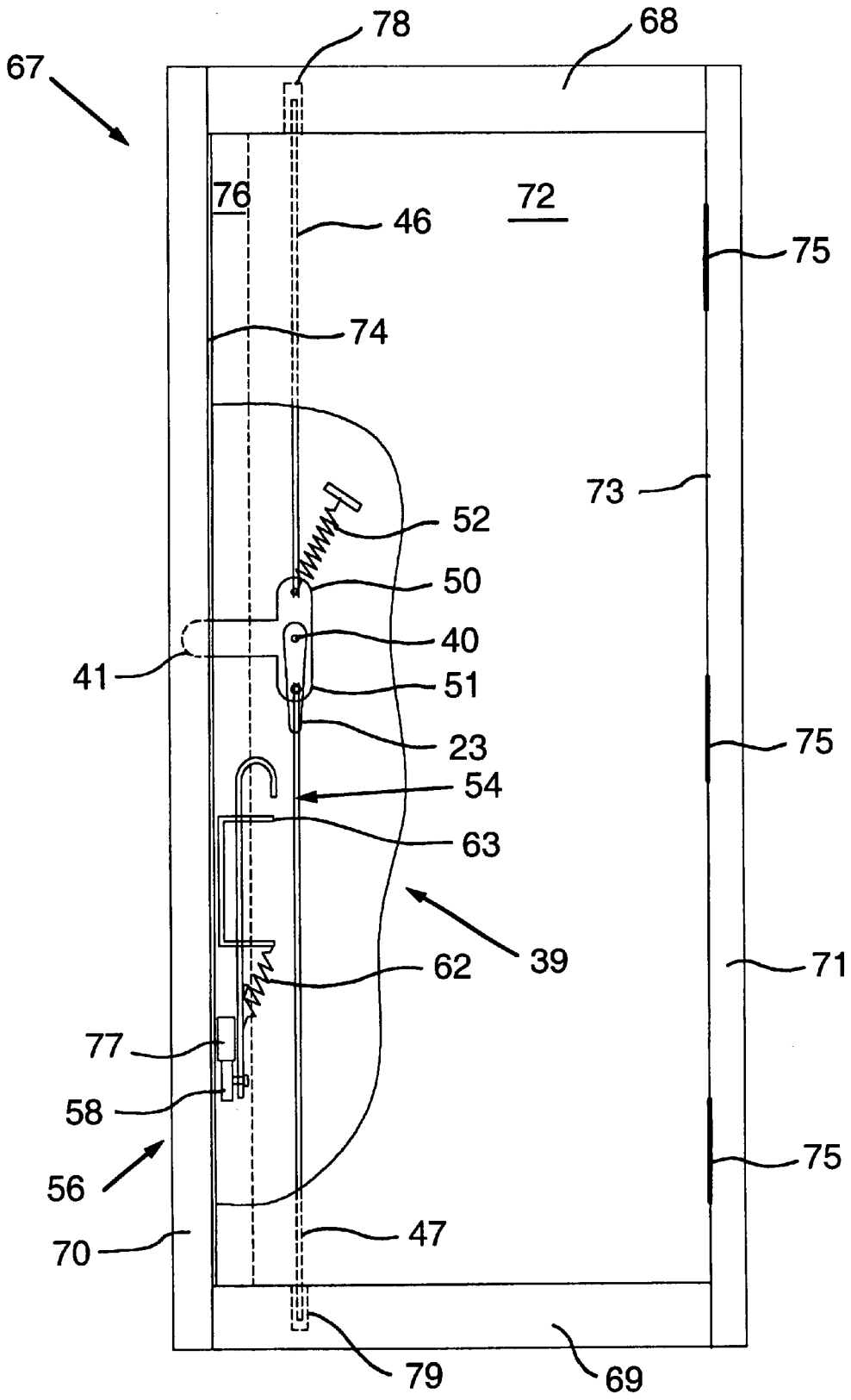
FIG. 10 is an elevational view of a single door safety cabinet with a portion broken away to show the first embodiment of the actuating means of the self-latching mechanism of the invention.

Although the invention is described in detail for use on a safety cabinet having two side-by-side sequentially closing doors, it can also be operable on a safety cabinet having a single self-closing door. Operation is similar to that described above with the exception that the latching arm engages a side door jamb of the frame of the door. FIG. 10 depicts safety cabinet 67 having top frame 68, bottom frame 69, latching side jamb 70 and hinging side jamb 71. Door 72 has hinging edge 73 and latching edge 74 and is hinged from hinging side jamb 71 by hinges 75. A lip, 76, extends laterally from latching side jamb 70 and overlaps door 72 along edge 74 when the door is closed. The overlapping provides a seal for the safety cabinet and provides a mounting surface for cam 77 which interacts with roller 58 of the self-latching mechanism. Latching rods 46 and 47 extend into apertures 78 and 79 in top and bottom frames 68 and 69 respectively, and latching arm 41 engages a slot in latching side jamb 70 when the door is latched. Operation of self-latching mechanism 39 in the single door application is identical to that discussed in relation to two door safety cabinet 11.

Figure 11:
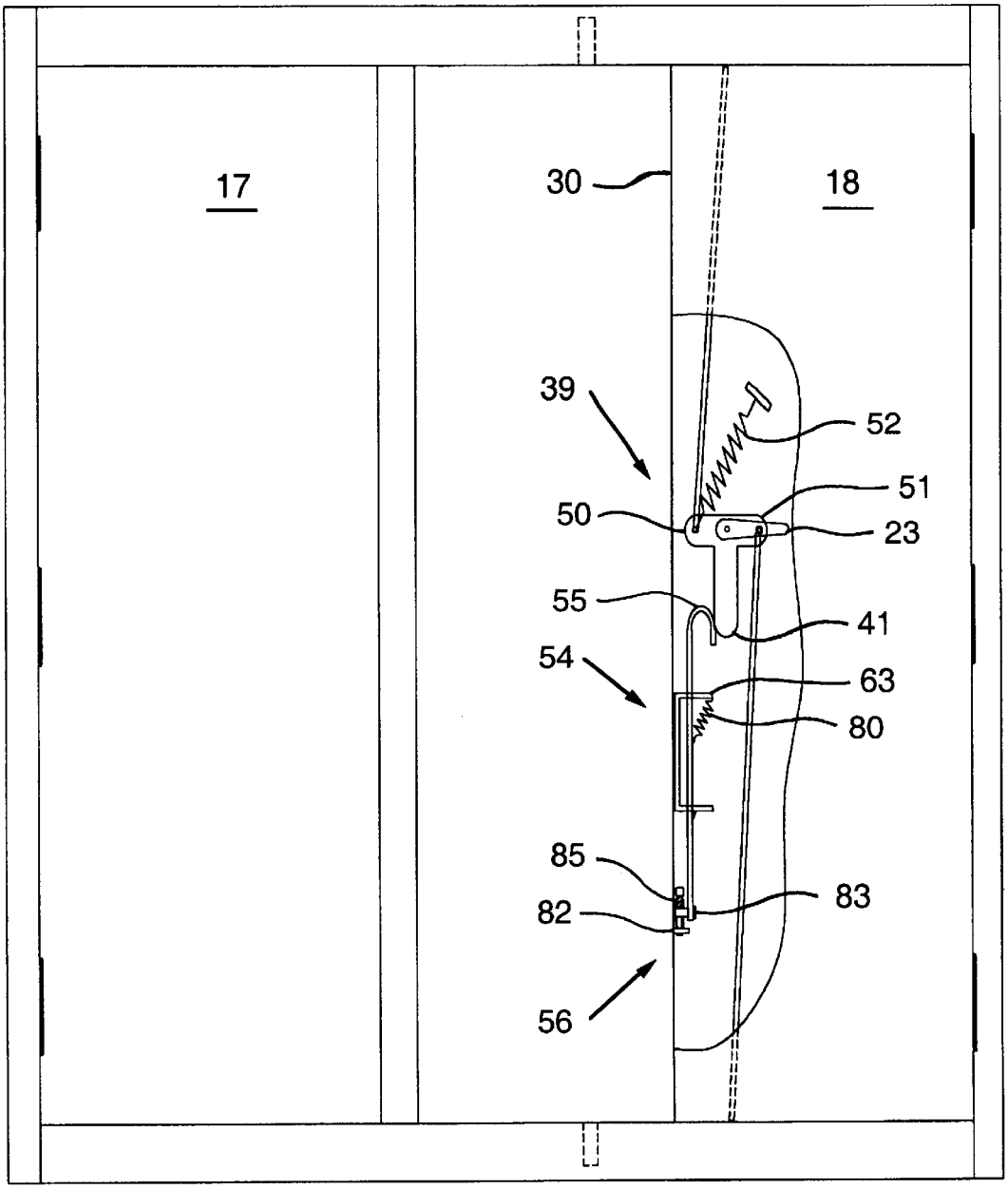
FIG. 11 is an elevational view of the safety cabinet with a portion broken away to show the second embodiment of the actuating means of the self-latching mechanism of the invention, in an unlatched position and the second-closing door open.
Figure 12A:
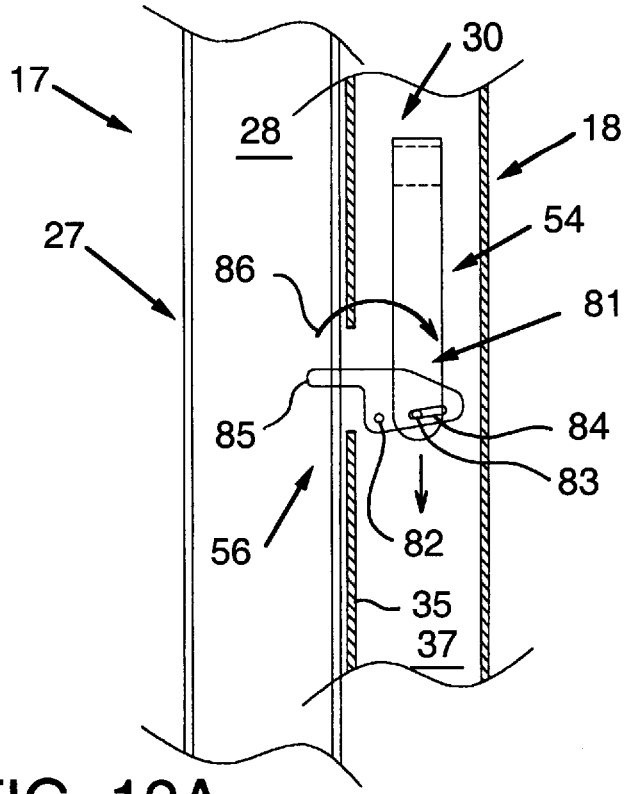
FIGS. 12A and 12B are partial sectional edge views of the first-closing and second-closing doors showing detail and operation of the second embodiment of the actuating means of the self-closing mechanism of the invention, with the second-closing door being open in FIG. 12A and closed in FIG. 12B.
Figure 12B:
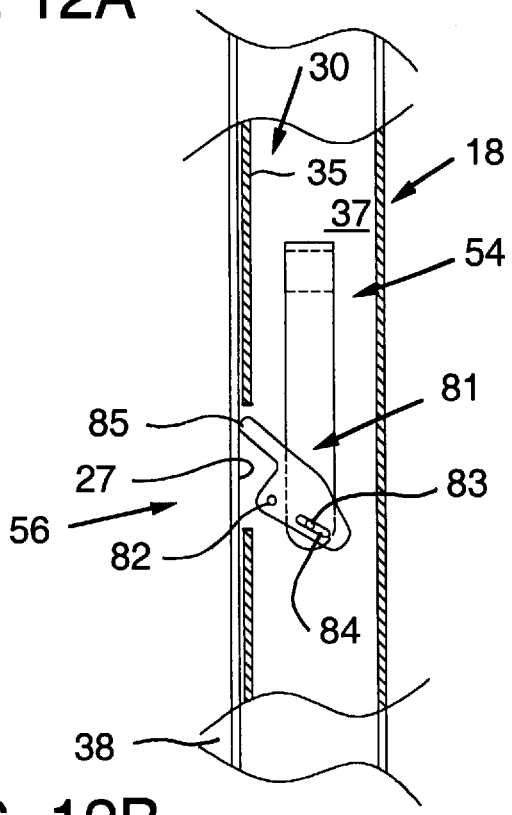
Figure 13:
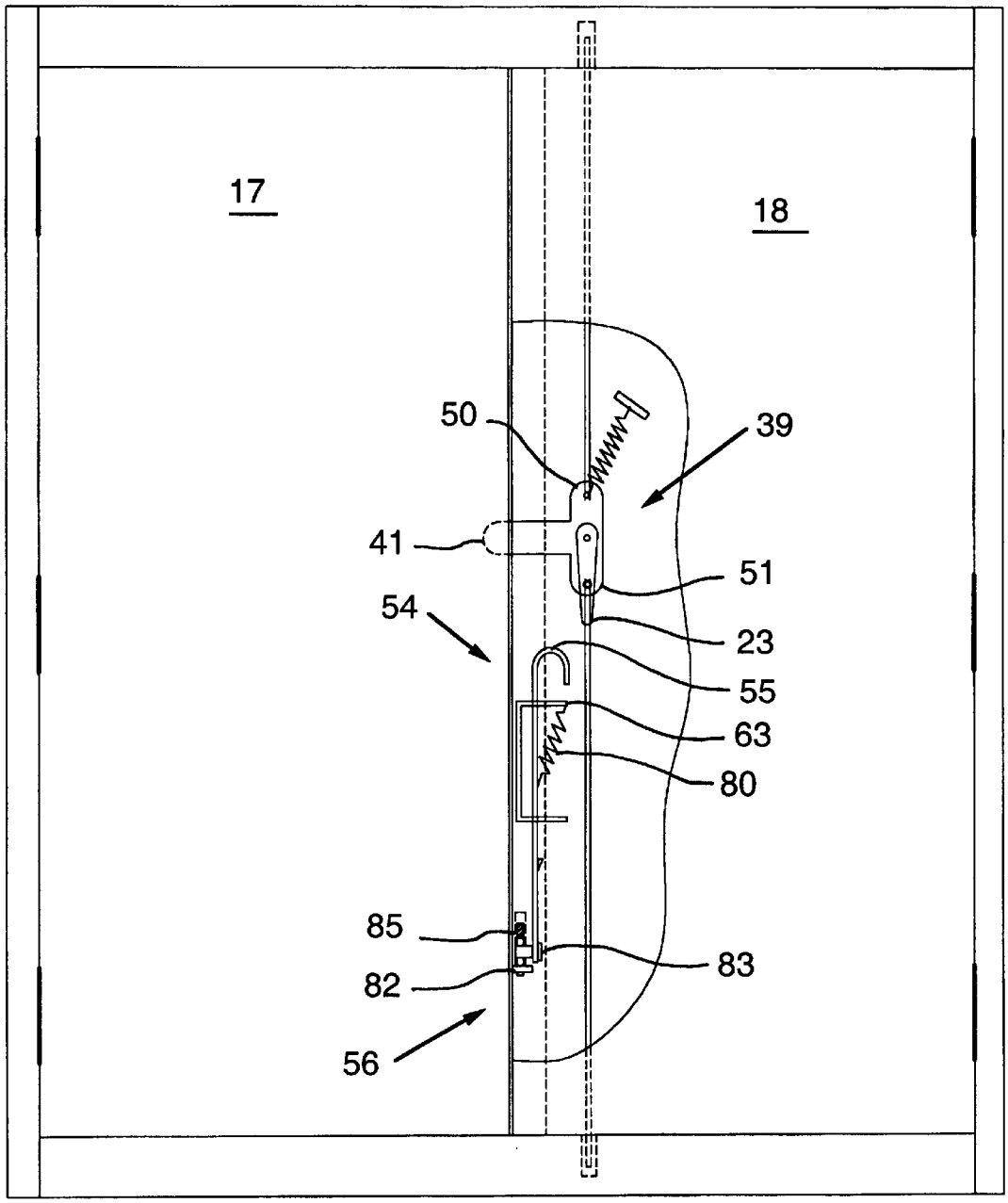
FIG. 13 is an elevational view of a safety cabinet with a portion broken away to show a second embodiment of the actuating means of the self-latching mechanism of the invention, in the latched position.

A second embodiment of the actuating means for positioning interference bar 54 is described, with reference being made to FIGS. 11–13. In FIGS. 11–13 the self-latching actuating means is indicated generally at 56. The function of interference bar 54 remains the same with the second embodiment of the actuating means, as with the first embodiment described, and therefore a description of that operation is not duplicated. FIGS. 11 and 12A depict interference bar 54 in the interference (upward) position which is maintained by biasing spring 80. Positioned at the lower end of interference bar 54 is the self-latching actuating means indicated generally at 56. Actuator lever 81 (FIGS. 12A and 12B) is pivotally mounted within door cavity 37 to latching edge 30 of second-closing door 18 by means of mounting pin 82 and is both slidably and pivotally engaged with the lower end of interference bar 54 by means of connecting pin 83. Connecting pin 83 extends horizontally from the lower end of interference bar 54 and rides in elongated aperture 84 in actuator lever 81. As best viewed in FIG. 11, the self latching mechanism is in the cocked condition ready for self latching. When in that condition, actuating means 56 is oriented in a manner best viewed in FIG. 12A. Trigger lobe 85 of actuator lever 81 is extending outwardly beyond interior facing panel 35 of second-closing door 18. Actuating lever 81 is oriented such that when latching edge 30 of second-closing door 18 approaches laterally extending lip 27, trigger lobe 85 makes contact with the lip and causes actuator lever 81 to pivot about mounting pin 82 as indicated by arrow 86 (FIG. 12A). That rotation results in elongated aperture 84 moving downwardly, and, through connecting pin 83, moving interference bar 54 downwardly so as to release spring biased bellcrank 39 to rotate clockwise for latching as described above.

The orientation of actuator lever 81, when the second-closing door 18 is completely closed, is shown in FIG. 12B. Trigger lobe 85 rests against lip 27 of first-closing door 17 and does not extend past facing panel 35 of the second-closing door. The position of interference bar 54, following complete closing of the doors, is best seen in FIG. 13. Interference bar 54 is in a lowered, non-interference, position and bellcrank 39 has rotated clockwise for latching.

When second-closing door 18 is opened to gain access to the contents of the cabinet, actuator lever 81 rotates in a direction opposite to that indicated by arrow 86 which raises interference bar 54 and positions trigger lobe 85 beyond facing panel 35 so as to be in position for causing self-latching during subsequent closing of the door.

While specific configurations and operational methods have been set forth for purposes of describing embodiments of the invention, various modifications can be resorted to, in light of the above teachings, without departing from applicant's novel contributions; therefore in determining the scope of the invention, reference shall be made to the appended claims.

What is claimed is:

1. A self-latching mechanism for a safety cabinet having an opening with a top frame, a bottom frame and opposing side jambs, a sequentially first-closing door hinged at a hinging edge to one of the jambs, a sequentially second-closing door hinged at a hinging edge to the remaining jamb, with each door having a latching edge, opposed to said hinging edge, a top and a bottom edge and an interior and exterior facing panel, all of which define a door cavity, and a lip extending laterally from the first-closing door to overlap the second-closing door along the latching edges which are adjacent when closed, said self-latching mechanism comprising a rotatable handle extending outward from the exterior facing panel of the second-closing door, a handle shaft attached to rotate with said handle and extend through the exterior facing panel into the door cavity, a bellcrank, attached to said shaft, rotatable with said handle, said bellcrank having a protruding latching arm to engage the latching edge of the first-closing door when the doors are closed and the bellcrank is in a latched position and to clear the latching edge when the bellcrank is in an unlatched position, and two protruding actuating arms, latching rods attached to said bellcrank and extending to provide latching at the top and bottom door frames, means for biasing said bellcrank toward said latched position, an interference bar, attached to be slidable to a position of either interference with or non-interference with said bellcrank, means for biasing said interference bar toward said position of interference with said bellcrank, actuating means to overcome the biasing means of the interference bar so as to slide the bar to a position of non-interference with the bellcrank and resulting latching of the doors when the second-closing door is closed subsequent to the first-closing door being closed.

2. The self-latching mechanism for a safety cabinet according to claim 1, wherein the means for biasing the bellcrank is a coil spring, and the means for biasing the interference bar is a coil spring.

3. The self-latching mechanism for a safety cabinet according to claim 1, wherein the interference bar is "J" shaped with a straight end and an opposite curved end, and interference with the bellcrank takes place by contact of the latching arm with the curved end of the interference bar.

4. The self-latching mechanism for a safety cabinet according to claim 1, further comprising a bracket for slidably attaching the interference bar to the second-closing door, and a tab projecting from the interference bar to limit sliding travel of said bar by contact with said bracket.

5. The self-latching mechanism for a safety cabinet according to claim 1, wherein said actuating means comprises a cam projecting from said laterally extending lip, a roller shaft attached to said interference bar, and a roller rotatably attached to said shaft, said roller positioned to contact said cam upon closing of the second-closing door to cause sliding of said interference bar to a position of non-interference with the bellcrank and resulting latching of the doors.

6. The self-latching mechanism for a safety cabinet according to claim 1, wherein said actuating means comprises an actuator lever, including a trigger lobe, pivotally attached to said second-closing door, said trigger lobe positioned to contact said first-closing door, upon closing of the second-closing door, to cause sliding of said interference bar to a position of non-interference with the bellcrank and resulting latching of the doors.

7. The self-latching mechanism for a safety cabinet according to claim 6, wherein said actuator lever is slidably and pivotally engaged with the interference bar.

8. A self-latching mechanism for a safety cabinet having an opening with a top frame, a bottom frame and opposing side jambs, a sequentially first-closing door hinged at a hinging edge to one of the jambs, a sequentially second-closing door hinged at a hinging edge to the remaining jamb, with each door having a latching edge, opposed to said hinging edge, a top and a bottom edge and an interior and exterior facing panel, all of which define a door cavity, and a lip extending laterally from the first-closing door to overlap the second-closing door along the latching edges which are adjacent when closed, said self-latching mechanism comprising a rotatable handle extending outward from the exterior facing panel of the second-closing door, a handle shaft attached to rotate with said handle and extend through the exterior facing panel into the door cavity, a bellcrank, attached to said extending shaft rotatable with said handle, said bellcrank having a protruding latching arm to engage the latching edge of the first-closing door when the doors are closed and the bellcrank is in a latched position and to clear the latching edge when the bellcrank is in an unlatched position, and two protruding actuating arms, latching rods attached to said bellcrank and extending to provide latching at the top and bottom door frames, a spring for biasing said bellcrank toward said latched position, a "J" shaped interference bar having a rounded end adapted to be slidable to a position to cause either interference or non-interference of its rounded end with said latching arm, a spring for biasing said interference bar toward said position of interference with said latching arm, a roller shaft extending from the interference bar in a direction perpendicular to the longitudinal axis of the bar, a roller rotatably attached to said roller shaft, a cam attached to the laterally extending lip of said first-closing door at a location to interact with said roller to overcome the biasing means of the interference bar and slide the bar to the position of non-interference with the latching arm to enable rotation of the bellcrank, by force of the bellcrank's biasing means, from the unlatched to the latched position when the second-closing door is closed subsequent to the first-closing door being closed.

9. A self-latching mechanism for a safety cabinet having an opening with a top frame, a bottom frame and opposing side jambs, a sequentially first-closing door hinged at a hinging edge to one of the jambs, a sequentially second-closing door hinged at a hinging edge to the remaining jamb, with each door having a latching edge, opposed to said hinging edge, a top and a bottom edge and an interior and exterior facing panel, all of which define a door cavity, and a lip extending laterally from the first-closing door to overlap the second-closing door along the latching edges which are adjacent when closed, said self-latching mechanism comprising a rotatable handle extending outward from the exterior facing panel of the second-closing door, a handle shaft attached to rotate with said handle and extend through the exterior facing panel into the door cavity, a bellcrank, attached to said extending shaft rotatable with said handle, said bellcrank having a protruding latching arm to engage the latching edge of the first-closing door when the doors are closed and the bellcrank is in a latched position and to clear the latching edge when the bellcrank is in an unlatched position, and two protruding actuating arms, latching rods attached to said bellcrank and extending to provide latching at the top and bottom door frames, a spring for biasing said bellcrank toward said latched position, a "J" shaped interference bar having a rounded end adapted to be slidable to a position to cause either interference or non-interference of its rounded end with said latching arm, a spring for biasing said interference bar toward said position of interference with said latching arm, an actuator lever, including a trigger lobe, pivotally attached to said second-closing door, and slidable and pivotally engaged with the interference bar, said trigger lobe positioned to contact said first-closing door, upon closing of the second-closing door, to pivot the actuator and cause sliding of said interference bar to a position of non-interference with the bellcrank and resulting latching of the doors.

10. A self-latching mechanism for a single-door safety cabinet having an opening with a top frame, a bottom frame, a hinging side jamb and an opposing latching side jamb, a door hinged at a hinging edge to the hinging side jamb, with the door having a latching edge, opposed to said hinging edge, a top and a bottom edge and an interior and exterior facing panel, all of which define a door cavity, and a lip extending laterally from the latching side jamb to overlap the door along its latching edge when closed, said self-latching mechanism comprising a rotatable handle extending outward from the exterior facing panel of the door, a handle shaft attached to rotate with said handle and extend through the exterior facing panel into the door cavity, a bellcrank, attached to said extending shaft rotatable with said handle, said bellcrank having a protruding latching arm to engage the latching side jamb when the door is closed and the bellcrank is in a latched position and to clear the latching side jamb when the bellcrank is in an unlatched position, and two protruding actuating arms, latching rods attached to said bellcrank and extending to provide latching at the top and bottom door frames, means for biasing said bellcrank toward said latched position, an interference bar, attached to be slidable to a position of either interference with or non-interference with said bellcrank, means for biasing said interference bar toward said position of interference with said bellcrank, actuating means to overcome the biasing means of the interference bar upon closing the door to cause sliding of said interference bar to a position of non-interference with the bellcrank and resulting latching of the door.

11. The self-latching mechanism for a single-door safety cabinet according to claim 10 wherein said actuating means comprises a cam projecting from said laterally extending lip, a roller shaft attached to said interference bar, and a roller rotatably attached to said shaft, said roller positioned to contact said cam upon closing of the door to cause sliding of said interference bar to a position of non-interference with the bellcrank and resulting latching of the door.

12. The self-latching mechanism for a single-door safety cabinet according to claim 10 wherein said actuating means comprises an actuator lever, including a trigger lobe, pivotally attached to said door, said trigger lobe positioned to contact said laterally extending lip upon closing of the door, to cause sliding of said interference bar to a position of non-interference with the bellcrank and resulting latching of the door.

* * * * *